US008096853B2

(12) United States Patent
Moehn et al.

(10) Patent No.: US 8,096,853 B2
(45) Date of Patent: Jan. 17, 2012

(54) PRE- AND POST-PROCESS BORE GAGING USING A HONING FEED SYSTEM EQUIPPED WITH FEED FORCE SENSING

(75) Inventors: David M. Moehn, Alton, IL (US); Daniel R. Cloutier, Clive, IA (US); Timothy P. Hoth, St. Peters, MO (US)

(73) Assignee: Sunnen Products Company, St. Louis, MO (US)

( * ) Notice: Subject to any disclaimer, the term of this patent is extended or adjusted under 35 U.S.C. 154(b) by 519 days.

(21) Appl. No.: 12/439,978

(22) PCT Filed: Sep. 5, 2007

(86) PCT No.: PCT/US2007/019344

§ 371 (c)(1), (2), (4) Date: Mar. 4, 2009

(87) PCT Pub. No.: WO2008/030463

PCT Pub. Date: Mar. 13, 2008

(65) Prior Publication Data

US 2010/0210181 A1 Aug. 19, 2010

Related U.S. Application Data

(60) Provisional application No. 60/842,321, filed on Sep. 5, 2006.

(51) Int. Cl.
*B24B 49/00* (2006.01)

(52) U.S. Cl. ..... 451/11; 451/21; 451/27

(58) Field of Classification Search ..... 451/9, 61, 451/5, 8, 21, 11, 27

See application file for complete search history.

(56) References Cited

U.S. PATENT DOCUMENTS 4,528,776 A * 7/1985 Estabrook ..... 451/150
5,269,103 A * 12/1993 Nagel et al. ..... 451/8
7,371,149 B2 * 5/2008 Cloutier et al. ..... 451/5

FOREIGN PATENT DOCUMENTS

EP 0575657 B1 12/1993

* cited by examiner

*Primary Examiner* — Robert Rose
(74) *Attorney, Agent, or Firm* — Matthews Edwards LLC

(57) ABSTRACT

The method of the invention provides a capability for accurately and uniformly determining the sizes of bores of workpieces, both pre- and post-process, to improve process control, particularly compensation for tool or stone wear and other factors, and process data collection. The present method makes all required bore measurements, including those in both the workpiece bore and the calibration ring or sample workpiece bore, with the honing tool, under controlled static, non-honing conditions, including expanding the tool in the bores in a predetermined manner, such as at a predetermined rate. The method of the invention has utility for honing multiple workpieces to a finished size with a single tool, and also for multiple spindle applications.

18 Claims, 5 Drawing Sheets

PRE- AND POST-PROCESS BORE GAGING USING A HONING FEED SYSTEM EQUIPPED WITH FEED FORCE SENSING

This application is submitted under 35 U.S.C. 371 claiming priority to PCT/US2007/019344, filed Sep. 5, 2007, which application claims the benefit of U.S. Provisional Application No. 60/842,321, filed Sep. 5, 2006.

TECHNICAL FIELD

This invention relates generally to gaging of bores, to be honed, and after being honed, and more particularly, to bore gaging using a feed force sensing capability of a feed system of a honing machine, for purposes such as to achieve improved accuracy, and making compensation for predicted tool wear for honing the compensation.

BACKGROUND OF THE INVENTION

Cloutier, et al, U.S. patent application Ser. No. 11/596,836 entitled Honing Feed System Having Full Control of Feed Force, Rate and Position, now U.S. Pat. No. 7,371,149, is incorporated herein by reference in its entirety. The disclosure of Cloutier, et al, U.S. Provisional Application No. 60/842,321, filed Sep. 5, 2006, is also incorporated herein by reference in its entirety.

Currently some new models of honing machines available from Sunnen Products Company are using a feed force sensing device to improve the control and results of the honing process. This technology is described in detail in the above-referenced pending U.S. and international patent applications, Cloutier, et al, Honing Feed System Having Full Control of Feed Force, Rate and Position.

Essentially, according to the present invention, the type of feed system described in the above-referenced pending patent application, and other feed systems with force sensing capability, can be used in conjunction with the honing tool itself to produce reliable pre- and post-processing gaging of the finished bore, or hole, herein interchangeably referred to by the term bore. Furthermore the data gathered and processed by the machine control computer during this step can be used to make accurate compensations for abrasive wear of the honing tool.

Current bore measuring methods can be generally categorized as post-process methods and in-process methods. The in-process methods primarily consist of either a plug gage that tries to enter the bore during the process or an air gage probe, either separate or built into the tool, measuring the bore during the process. Post-process gaging can vary in sophistication from manually placing a bore gage in the bore to automated air gage probes that enter the bore and take multiple readings. No known methods exist where the tool itself, lacking any dedicated measuring attachment, is used to measure the size of the finished bore.

In the past, most honing feed systems did not have the ability to accurately measure both feed force and feed position. Since the elements of the feed system and honing tool are not perfectly rigid and exhibit some degree of elasticity, it is impractical to attempt to use the honing feed system as a bore measuring system unless both force and position can be measured accurately.

One example of prior art, does combine both force and position measurement. European Patent No. EP 0 575 657 B1 (Grimm, et al, Method and Machine for Finishing a Bore in a Work Piece) uses a feed force measuring device, for determining a target end point (final encoder position) before the honing process begins. This method uses a calibration ring (or sample workpiece) that has been made with a bore size equal to the desired final bore size. The honing tool is expanded in the bore of this calibration ring until a certain level of force is measured in the feed force measuring device. To minimize errors arising from tool and feed system elasticity, the last recorded feed force of the last honing cycle is used. When this force is reached with the tool in the calibration ring, the feed system position is recorded as the target position for the next honing cycle.

An observed shortcoming of the above-discussed disclosure of Grimm et al., however, is that no post-process measurements of the honed bore are made to verify the achievement of the desired bore size. Thus, no capability is provided for the machine control system to gather accurate process data for purposes such as improving the accuracy of the honing process.

Another observed shortcoming in the disclosure of Grimm et al., is that no difference between measurements made under static and dynamic conditions is noted or recognized. In Grimm et al., in the calibration ring, the feed force and position are measured under static conditions, that is with no relative rotation and/or stroking of the tool and workpiece, but, in the workpiece bore, the measurements are made under the dynamic conditions of the honing process, i.e., the honing tool is at least rotating and there may be a relative stroking motion between the tool and the bore. Experience has shown that forces and positions recorded under dynamic conditions will not exactly result in the same bore measurement as when the same level of force is applied under static conditions.

Still further, in the Grimm et al. disclosure, compensation for tool wear is made periodically, based on differences between feed position measurements taken in the calibration ring before and after at least one workpiece has been honed, and thus, as another shortcoming, the compensation is not applied to the immediately affected workpiece or workpieces, but instead, to subsequently honed workpieces.

Accordingly, what is sought is a capability of making pre- and post-process measurements of bores of honed workpieces, that verify the desired bore size and allow the ability for the machine control system to gather accurate process data for purposes including improving the accuracy of the honing process and compensation for tool wear.

SUMMARY OF THE INVENTION

According to the invention, a capability of making measurements of bores of workpieces, both pre- and post-process, that enables verifying bore size before honing, and allows more accurately determining honing parameters for reaching a desired finished bore size, including amount of stock or material to be removed, and accompanying tool wear, and the ability for the machine control system to gather accurate process data, for purposes including improving the accuracy of the honing process, is disclosed.

According to a preferred aspect of the invention, the present invention makes all comparative bore measurements, that is, those in both the workpiece bore and the calibration ring or sample workpiece bore, under static conditions.

According to another preferred aspect of the invention, the present invention makes tool wear compensations before the workpiece bore is honed, as a function of the amount of stock or material to be removed from the workpiece in the honing operation.

DESCRIPTION OF THE PROPOSED INVENTION

Figure 1:
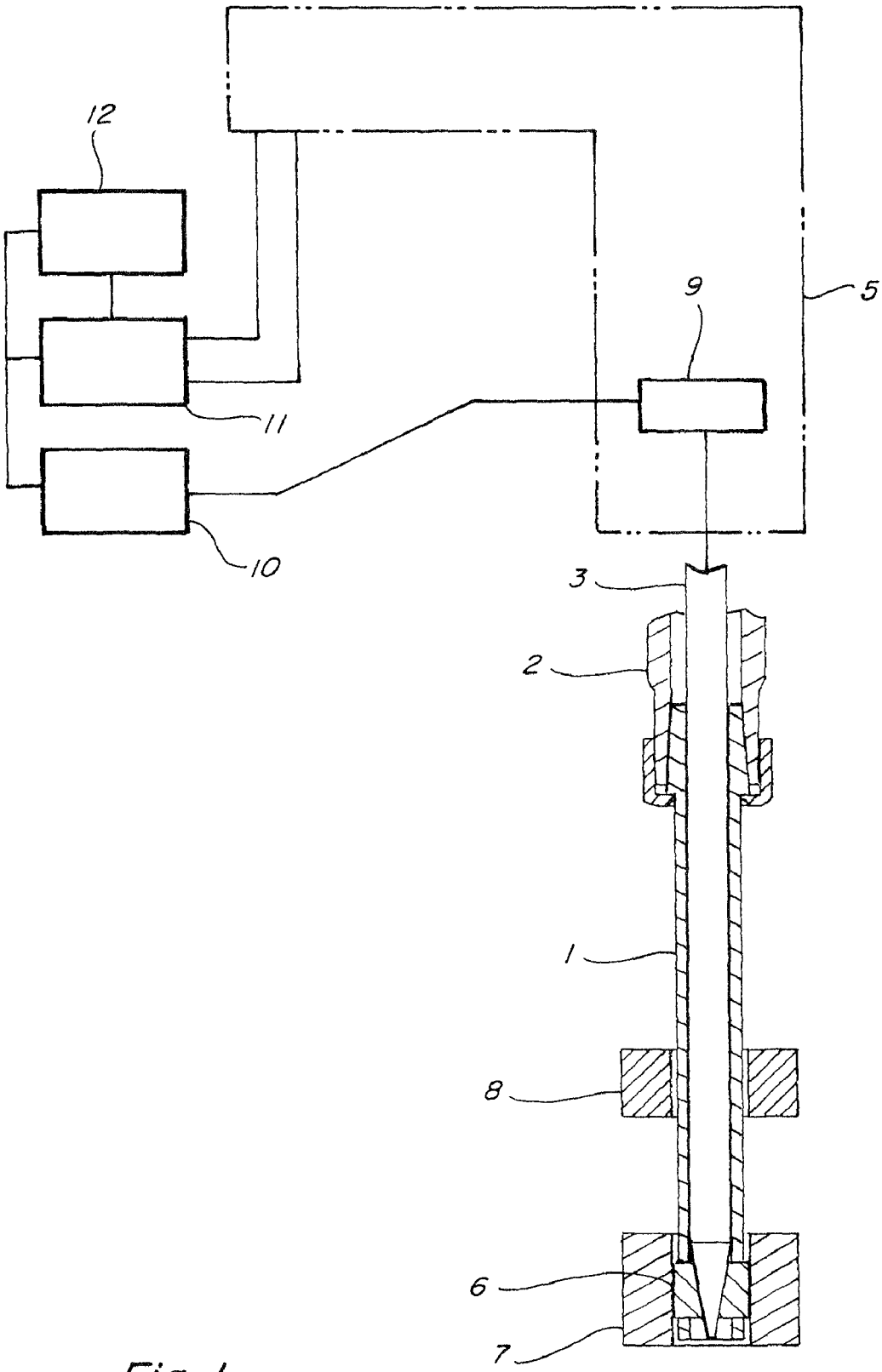
FIG. 1 is a simplified schematic representation of aspects of a representative honing machine for performing steps of the method of the present invention, including a feed system, a honing tool, and a calibration ring, and showing the honing tool disposed in position in a bore of a representative workpiece to be honed.

Referring to FIG. 1, a honing tool 1 is fixed in the spindle 2 of a honing machine (not shown), which machine can be for instance, any of a variety of machines that provide all the usual required motions for abrasive bore finishing processes (spindle rotation and axial reciprocation of spindle or workpiece). The honing tool contains a wedge 3 which is driven axially by a feed system 5. (Detail of one possible embodiment of the feed system can be seen in FIG. 5, disclosed more particularly in Cloutier, et al, Honing Feed System Having Full Control of Feed Force, Rate, and Position, incorporated herein by reference above.) The end of the wedge bears against abrasive stones 6, thereby feeding them into the bore of the workpiece 7.

The feed force developed in the wedge and feed system is measured by a load cell 9 which transmits an electronic signal back to an amplifier 10 (if required). Power and signals run between the amplifier and the honing machine computer control 12 and to a computer controlled motor drive 11. The control of these devices results in signals that precisely control a feed motor or some other driving component of the feed system 5.

Figure 4:
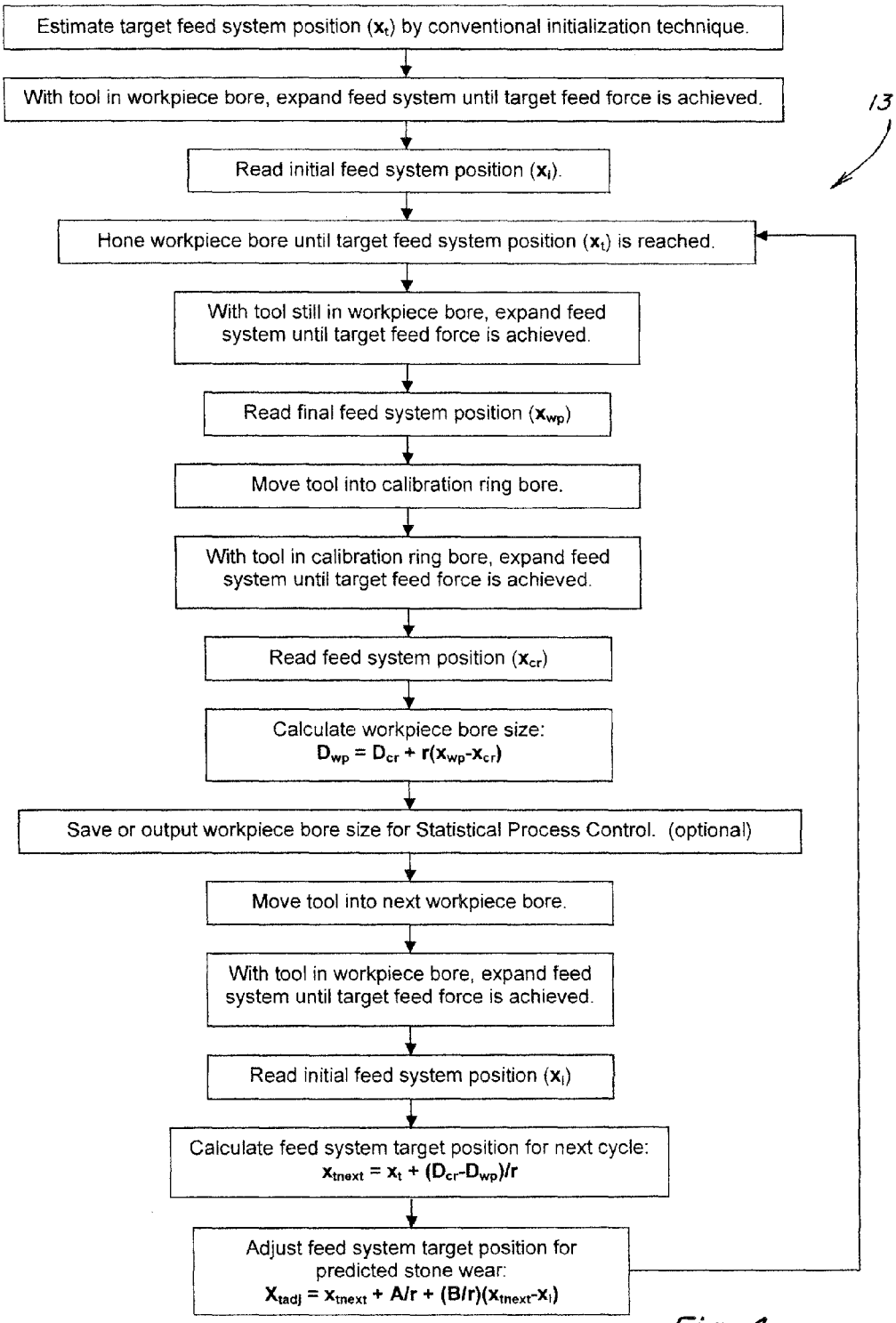
FIG. 4 is a high level flow diagram illustrating steps of a preferred embodiment of a method of the invention.

Referring also to FIG. 4, which contains a flow diagram 13 showing steps of one embodiment of the method of the invention, when honing a group of workpieces, the first workpiece must somehow be honed to finished size or close to finished size. This could be done by using any number of conventional initialization techniques. (One such method is described hereinbelow, and in Cloutier, et al, Honing Feed System Having Full Control of Feed Force, Rate, and Position, incorporated herein by reference above.)

When the honing of the first workpiece is complete the spindle and stroking motion will stop. The feed system will then retract the abrasive stones 6. Then the feed system will move to once again expand the stones in the same bore of workpiece 7, this time, though, expansion will be under static conditions, that is, without relative rotational and/or reciprocating movements of the honing tool and workpiece as would be used for actual honing, wherein material or stock is removed from the surface of the bore. The expansion will proceed at some predetermined rate until the load cell 9 senses that a predetermined or target level of force has been reached. At that point, the position of the feed system (as determined by an encoder in the feed system) will be recorded, as a target feed system position.

The feed system then again retracts the stones and the machine moves the tool up out of the workpiece bore until the abrasive stones are uniformly inside the calibration ring 8. The calibration ring most likely will have a bore that is exactly the desired finished size, although the methods described here will work with any size of ring as long as the difference between the ring's size and the desired finished size is included in the control system calculations. For simplicity the calculations shown here will assume the calibration ring has been made to the exact desired finished size.

With the stones inside the calibration ring, the feed system is again expanded at the same predetermined rate until the same predetermined target feed force is reached. At that point, the position of the feed system is again recorded. This position measurement is compared to the measurement made in the workpiece bore and the true size of the workpiece bore can then be calculated from the following:

$$D_{wp}=D_{cr}=+r(x_{wp}-x_{cr})$$

where $D_{wp}$=Diameter of workpiece bore (mm)

$D_{cr}$=Diameter of calibration ring (mm)

$x_{wp}$=Encoder position of workpiece measurement (counts)

$x_{cr}$=Encoder position of calibration ring measurement (counts)

r=Combined feed system and tool ratio (mm of diametrical stone expansion per encoder count)

This information can then be used to make a bore size compensation for the honing of the next workpiece. Also this information can be saved and/or output for purposes of Statistical Process Control.

Since this measurement step is not a required part of the honing process, it does not need to be performed on every workpiece. The operator of the honing machine can select the frequency at which the final bore size measurement will be taken.

Stone Wear Measurement, Prediction and Compensation

Figure 2:
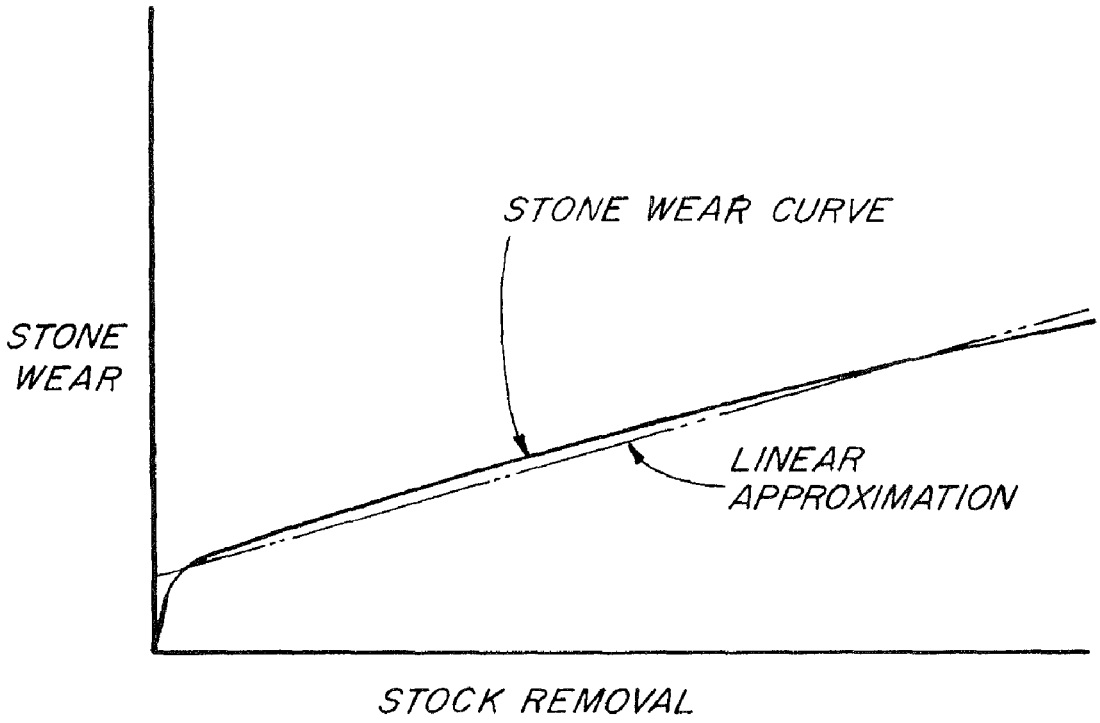
FIG. 2 is a simplified graphical representation of stone wear verses stock removal according to the method of the invention.

It is necessary to at least periodically measure the finished workpiece bore because the abrasive stones continually wear down during the honing process. This stone wear, also referred to as tool wear, results in bore size errors. Many factors affect the amount of stone or tool wear that will occur in a honing cycle, but most of those factors are held constant throughout the process and therefore will not contribute to short term variations in stone wear. One significant factor that often varies widely from one workpiece to the next is the amount of stock or workpiece material to be removed from the bore (stock removal). The stone or tool wear increases as the amount of stock removal increases. Depending on the conditions and hardness of the in-coming workpiece bores, this relationship could be a simple proportion or it could be more complex. An example is shown in FIG. 2. For most applications a linear approximation of the relationship between stone wear and stock removal will be sufficient, however it is foreseen that more complex curve fitting techniques could be used if a specific application presents such a sufficiently non-linear relationship between stone wear and stock removal.

The present invention provides a method to accurately measure both stock removal and stone wear for any given honing cycle or series of honing cycles. The process described above constitutes one set of measurements required. Another measurement will also be required. It will be necessary to measure the initial diameter of the workpiece bore. This will occur at the beginning of the cycle after any bore compensation from the previous cycle has been made by the control system. The method of measurement is identical to that described above. Under static conditions the feed system expands the stones into the workpiece bore at a predetermined rate until a predetermined force is measured by the load cell. (This process is equivalent to the feature described as Automatic Bore Detection in Cloutier, et al, Honing Feed System Having Full Control of Feed Force, Rate, and Position.)

After the honing cycle is complete and the final bore size measurement is taken as described above, the control system will have recorded three measurements:

$x_i$=initial feed system position (counts)

$x_f$=final feed system position (counts)

$x_t$=target feed system position (counts)

By application of the combined ratio of the feed system and tool, these can equivalently be expressed as diameters:

$D_i=r(x_i-x_0)$ where $D_i$=initial diameter (mm)

$D_f=r(x_f-x_0)$ where $D_f$=final diameter (mm)

$D_t=r(x_t-x_0)$ where $D_t$=target diameter, i.e. calibration ring (mm) and where $x_0$=some offset (counts) corresponding to an encoder position where the diameter would equal zero Stock removal, s (mm) and stone wear, w (mm) are then calculated as follows:

$w=D_t-D_f=r(x_t-x_f)$ $s=D_f-D_i=r(x_f-x_i)$ or $s=D_t-D_i-w$

A target feed position $x_{tnext}$ for honing the next workpiece, and adjustment for stone wear, $x_{tadj}$, can be determined using the equations shown at the bottom of the flow diagram of FIG. 4.

It is understood that stone wear in many applications may be small enough that it is unnecessary to measure the final bore size on every workpiece honed. Assume then the frequency of final bore checking to be every n workpieces. (Note: Since the in-coming bore size can vary, the initial bore size of every workpiece must be recorded and summed for the group of n workpieces.) For a group of n workpieces then, $\bullet w=D_t-D_f$ (measured at the last workpiece only)

$\bullet s=nD_t-\bullet d_i-\bullet w$

If the relationship between stone wear and stock removal is assumed to be linear, then the form of that function can be written as, $w=A+Bs$ for a single workpiece, or $\bullet w=nA+B\bullet s$ for a group of n workpieces where A and B are unknown constants.

At least two groups will need to be measured in order to determine A and B by conventional linear regression techniques. After they have been determined, then the relationship between stone wear and stock removal can be assumed to be known and the above relationship can be used to calculate the expected amount of stone wear before the honing cycle begins. That amount of stone wear can then result in an accurate bore size compensation for anticipated stone wear applied at the beginning of the honing cycle to result in the finished bore size being very close to the target bore size within a minimal range of error. That workpiece-specific bore size compensation will be based on the measured amount of stock removal for that specific bore and calculated from the formula above for w.

It is understood that the conditions of honing may change over time and the relationship of stone wear to stock removal may also change over time. It may be desirable to continually update the constants A and B based on the most recent groups of measurements. This is easily done, however the formulae above are based on the assumption that no bore size compensations are made throughout the entire run of the group being measured. If bore size compensations are made during the run of the group (either manually or automatically as described above) then those compensations must be summed. The formula for •w above must then be replaced by:

$\bullet w=D_t-D_f+\bullet c$ where •c=the sum of all bore size compensations made during the run of the group All discussion and calculations above assume that bore measurements are made at a constant feed force level. This will inherently remove any effect of tool and feed system elasticity. However a known method for removing the effects of elasticity is described in Cloutier, et al, Honing Feed System Having Full Control of Feed Force, Rate, and Position, so it is anticipated that the method described by this invention could in fact be accomplished at different levels of feed force so long as the methods of this prior art are applied during the measurement process.

Multiple Spindle Honing Operations

Figure 3:
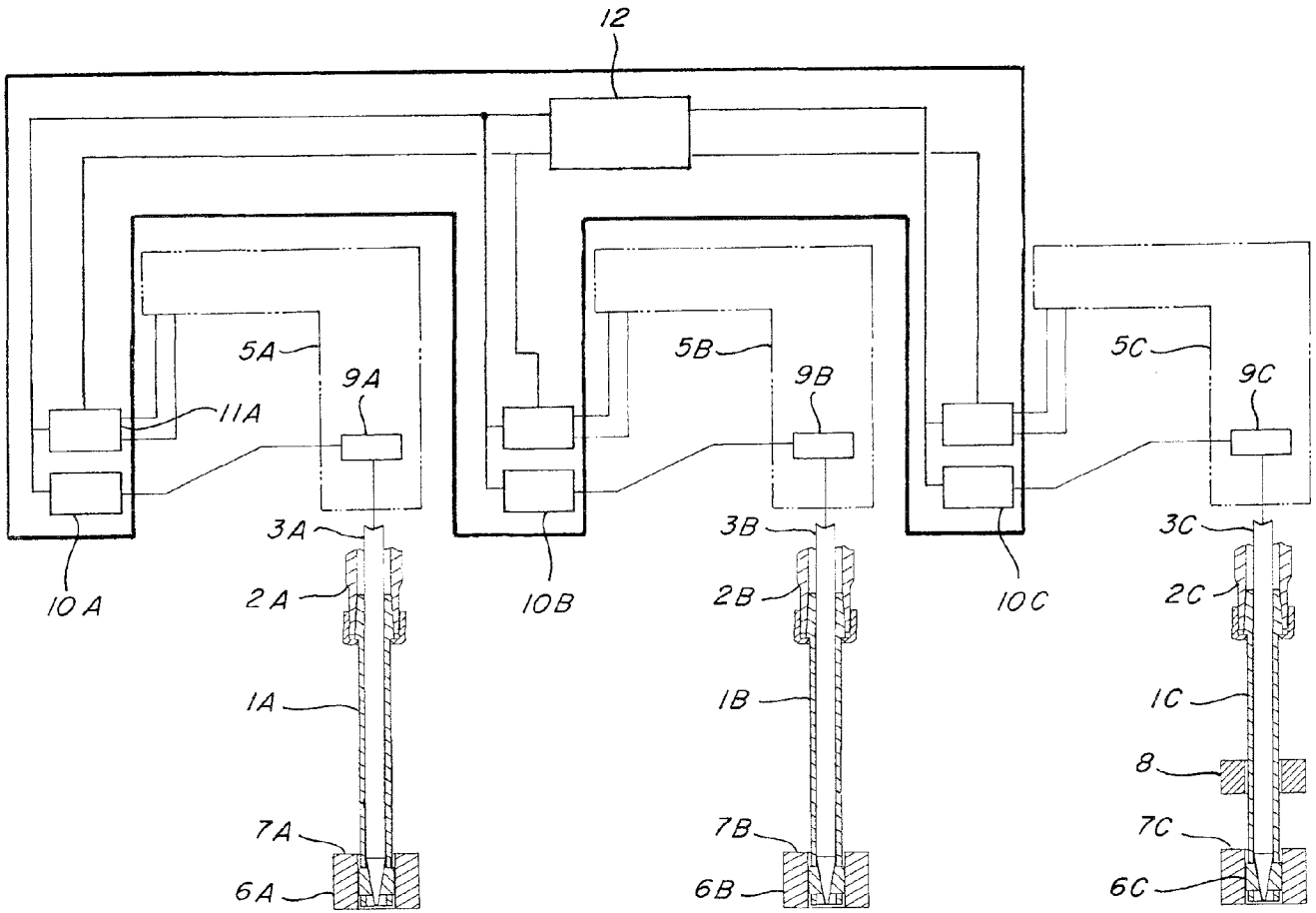
FIG. 3 is a simplified schematic representation of aspects of a representative multiple spindle honing machine for performing steps of the method of the present invention, including respective feed systems for the spindles, a honing tool of each of the spindles disposed in bores of workpieces to be honed, and a calibration ring in association with one of the honing tools.

Referring also to FIG. 3, some honing machines use multiple spindles (i.e. tools) in succession to achieve the final finished bore (e.g. a rough honing tool followed by a finer finish honing tool). For instance, here, three honing tools 1A, 1B and 1C are used. Tools 1A, 1B and 1C are mounted in separate spindles 2A, 2B and 2C of a honing machine which provides all the usual required motions for abrasive bore finishing processes (spindle rotation and axial reciprocation of spindle or workpiece). The honing tools contain wedges 3A, 3B and 3C, respectively, driven axially by a feed system 5A, 5B or 5C. (Detail of another possible embodiment of the feed system can be seen in Cloutier, et al, Honing Feed System Having Full Control of Feed Force, Rate, and Position.) In each of the tools, the end of the wedge bears against abrasive stones 6A, 6B or 6C, thereby feeding them into the bore of the workpiece 7.

For each of the tools, the feed force developed in the wedge and feed system is measured by a load cell 9A, 9B or 9C which transmits an electronic signal back to an amplifier 10A, 10B or 10C (if required). Power and signals run between the amplifiers and the honing machine computer control 12 and to a computer controlled motor drive 11A, 11B or 11C for each tool. It is not necessary to have a calibration ring 8 for each spindle 2A, 2B and 2C. It is sufficient for only the last spindle 2C to have a calibration ring 8 or some other post process method of accurately measuring the final bore size.

In operation, the workpiece 7C just finished by the last honing tool 1C is measured either by the method described above (using calibration ring 8) or by some other post process method of bore gaging. Any bore size compensation that is subsequently determined for that last tool is then made to that last tool. The workpiece transfer device (not shown) then indexes presenting the next workpiece to each spindle. The workpiece now under the last spindle is the one completed by the previous spindle. The tool enters the workpiece and under static conditions the tool is expanded until the abrasive stones contact the bore wall. When this contact is made and feeding stops, the encoder of the feed system can be read. Following the method previously described, this encoder reading can be mathematically converted to a bore size for that particular workpiece. If that size varies from the target bore size for that previous tool then the appropriate bore size compensation can be made for that previous tool using only the information obtained at the subsequent tool (i.e. no calibration ring will be needed for the previous tool).

If more than two spindles are present, the tool prior to the tool that was just compensated can now be measured and compensated using the same method. This can continue for any number of spindles with the sequence of compensations flowing from last tool to the first tool with each tool being calibrated by means of the bore measurement made from the tool that follows it in the honing operation but has preceded it in this calibration operation.

Figure 5:
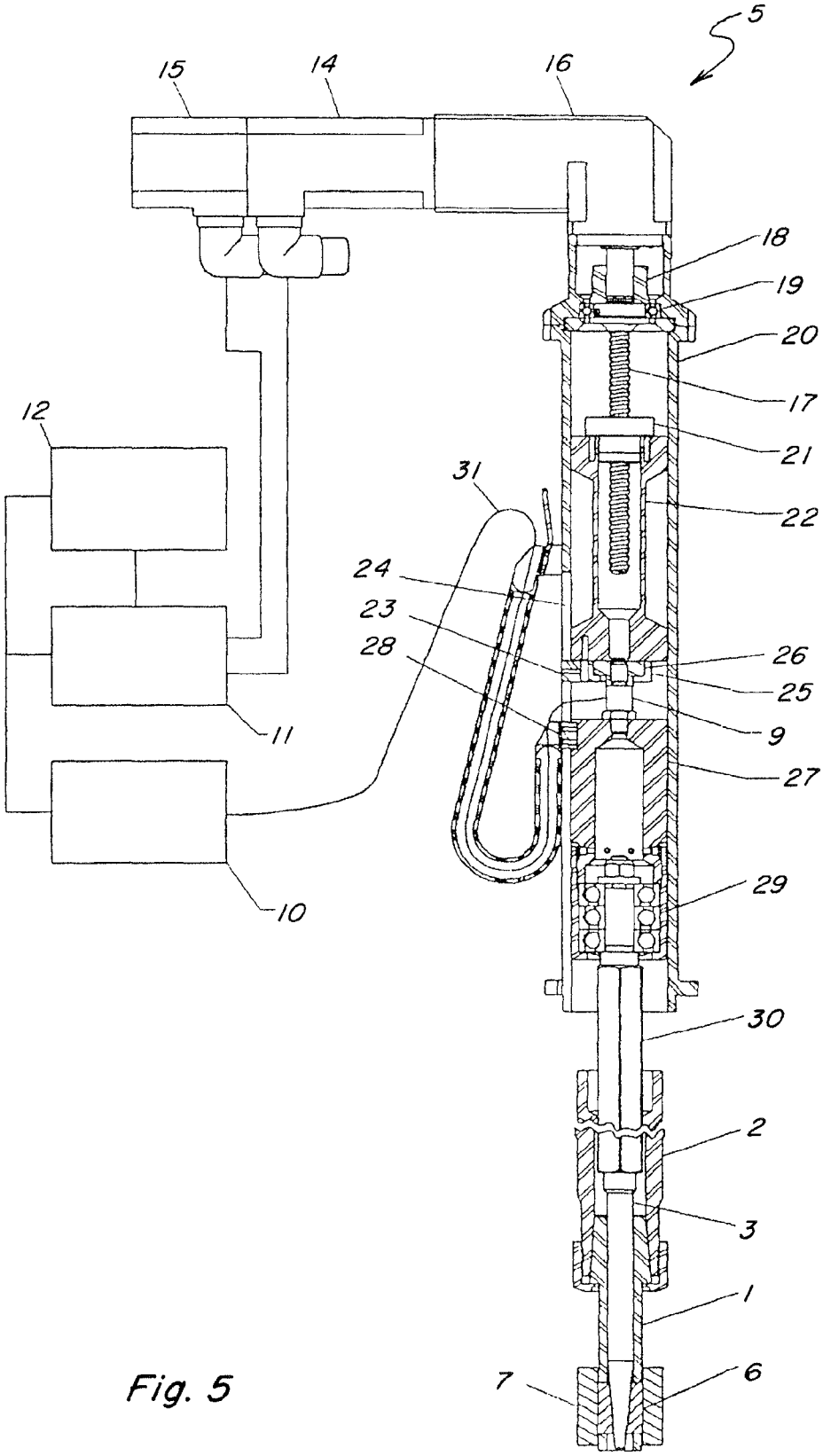
FIG. 5 is a side view, in partial section, of a representative honing machine spindle with which the invention can be used.

FIG. 5 illustrates additional aspects of one possible feed system 5 with which the method of the invention can be used. A feed motor 14 of drive 11 is connected to (or is integral with) an encoder 15. If needed to provide the desired characteristics of output torque, output speed, and linear travel per encoder count, a gear reducer 16 may be attached to the shaft of the feed motor 14. The gear reducer output shaft is connected to a ball screw assembly 17 by a coupling 18. The ball screw assembly 17 resists axial motion by means of ball bearing 19 held in a feed system housing 20. (The feed system housing 20 may consist of several pieces as required for ease of manufacturing and assembly.) The ball screw engages a ball nut 21 that is attached to a ball nut carrier 22. The ball nut carrier 22 is prevented from rotating by a key 23 that engages a slot 24 in the feed system housing 20. Rotation of the feed motor 14 and subsequently the output shaft of the gear reducer 16 causes the ball screw to rotate, which in turn imparts a linear motion to the ball nut 21 and its carrier 22. The key 23, in this embodiment, is integral with a retainer 25 that has a pocket to hold a round disc 26. The round disc 26 is attached to one threaded end of load cell 9. The pocket has a very small amount of clearance with the round disc 26 for the purpose of allowing the round disc 26 to align itself with the components below without creating any undesirable stresses on the load cell 9. The load cell 9 is fastened to a non-rotating feed rod 27, which is prevented from rotating by a key 28 which also engages the previously mentioned slot 24 in the feed system housing 20. The non-rotating feed rod 27 is attached to a tube holding an arrangement of angular contact bearings 29. The rotating races of the bearings 29 are attached to a rotating feed rod 30. The rotating feed rod 30 is splined or keyed by some means so that it will rotate with the honing machine spindle shaft 2 and yet allows relative axial motion between the spindle shaft 2 and the feed rod 30. The spindle shaft 2 holds the honing tool 1 which contains a wedge for expanding abrasive honing elements 6 into the bore of the workpiece 7. The wedge is attached to the feed rod 3 and is allowed to move axially with the feed rod 3 while the tool 1 is restrained from axial movement by its connection to the spindle shaft 2. This relative axial motion of the wedge and tool 1 creates the expanding/retracting motion of the abrasive honing elements 6. The feed system housing 20 and the spindle shaft 2 are both connected to carriage of a honing machine that strokes them together to generate the axial reciprocation of the honing process.

The axial force of the wedge to expand the honing elements is developed from the torque of the feed motor and converted to a linear force by the ball screw and nut and then transmitted through the load cell to the feed rod and wedge. The load cell therefore always senses the full axial feed force of the honing process. The load cell cable 31 is carried through a cable carrier to an amplifier 10 (if required). Power to and signals from the load cell run through this cable and amplifier to a processor based feed control and a servo controller of the feed drive, in connection with motor 14 and encoder 15. The control of these devices result in signals that precisely control the motion of the feed motor.

There are two basic methods of feed control. The first is feed rate control, where the control system keeps the feed motor moving at a constant rate or controlling the rate to some programmed profile that is at least partially a function of feed position. The second basic method of feed control is force control, where the control system keeps the feed motor moving in a manner such that the feed force is held constant or follows some programmed profile that is at least partially a function of feed position.

Computer control also allows for these two basic methods to be mixed within a honing cycle, e.g. honing at a controlled rate until some condition is met then honing at controlled force until the bore is at final size. Furthermore the computer control allows for a high degree of flexibility in feed control programming. Parameters such as feed rate, feed force, spindle torque, time, number of reciprocation strokes, workpiece temperature, and others can be used in real-time control logic that adapts the controlled feed parameter or even changes the feed control method in a simple or complex programmed manner.

It will be understood that changes in the details, materials, steps, and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention. Accordingly, the following claims are intended to protect the invention broadly as well as in the specific form shown.

What is claimed is:

1. A method of determining a size of a bore of a workpiece honed using a honing tool assembled to a honing machine feed system capable of measuring feed forces exerted against the tool and feed system positions representative of feed positions of the tool, comprising steps of:

expanding the tool within the bore of the workpiece, under static conditions, until a predetermined feed force is reached, and measuring the feed system position;

positioning the tool in a bore of known size and expanding the tool, under the static conditions, until the predetermined feed force is reached, and measuring the feed system position;

determining a value representative of the size of the bore of the workpiece, as a function of the measured feed system position for the tool in the bore of known size, and the measured feed system position for the tool in the bore of the workpiece.

2. A method as claimed in claim 1, comprising a further step of utilizing the value representative of the size of the bore of the workpiece for statistical process control.

3. A method as claimed in claim 1, comprising steps prior to the honing of the bore of the workpiece, of:

determining a value representative of predicted stone wear for honing the bore of the workpiece;

determining a target feed system position for honing the bore of the workpiece to a target size, as a function of the target size and the value representative of predicted stone wear; and honing the bore of the workpiece until the target feed system position is reached.

4. A method as claimed in claim 3, wherein the value representative of predicted stone wear is determined as a function of an amount of stock to be removed by the honing of the bore to the target feed system position.

5. A method as claimed in claim 4, wherein the value representative of predicted stone wear is determined at least in part, from measurements of stone wear for at least one previously honed workpiece.

6. A method as claimed in claim 1, wherein the steps of expanding the tool comprise expanding the tool at a predetermined rate.

7. A method as claimed in claim 1, comprising an additional step of determining a feed system compensation value as a function of the measured feed system position for the tool in the bore of known size, and the measured feed system position for the tool in the bore of the workpiece.

8. A method as claimed in claim 7, comprising a further step of determining a target feed system position as a function of the feed system compensation value and a value representative of predicted stone wear for a subsequent honing step.

9. A method as claimed in claim 7, comprising an additional step of using the feed system compensation value for determining a target feed system position for honing the bore using another honing tool.

10. A method as claimed in claim 1, wherein the bore of known size comprises a bore of a calibration ring or a sample workpiece.

11. A method of honing a bore of a workpiece using a honing tool assembled to a honing machine feed system capable of measuring feed forces exerted against the tool and feed system positions representative of feed positions of the tool, comprising steps of:

expanding the tool within the bore of the workpiece, under static conditions, until a predetermined feed force is reached, and measuring the feed system position;

determining a predicted feed system compensation value for tool wear for honing the bore to a target size, as a function of at least the measured feed system position, the target size, and a predetermined value for tool wear as a function of feed system position;

determining a target feed system position for honing the bore, as a function of the predicted value for tool wear and the target size; and honing the bore until the target feed system position is reached.

12. A method as claimed in claim 11, where in the step of expanding the tool, the tool is expanded at a predetermined rate.

13. A method as claimed in claim 12, comprising further steps of:

retracting the tool in the honed bore, then expanding the tool therewithin, under the static conditions and at the predetermined rate, until the predetermined feed force is reached, and measuring the feed system position;

positioning the tool in a bore of known size and expanding the tool, under the static conditions and at the predetermined rate, until the predetermined feed force is reached, and measuring the feed system position; and determining a feed system compensation value as a function of at least the measured feed system position for the tool in the bore of known size, and the measured feed system position for the tool in the honed bore.

14. A method as claimed in claim 13, comprising a further step of determining a new feed system target value as a function of the feed system compensation value.

15. A method as claimed in claim 14, wherein the feed system target value is used for honing a subsequent workpiece.

16. A method as claimed in claim 11, wherein the predetermined value for tool wear is determined from a determination of tool wear from honing bores of at least two previous workpieces.

17. A method for automatically honing bores of a plurality of workpieces to a target size, using a honing tool assembled to a honing machine feed system capable of measuring feed forces exerted against the tool and feed system positions representative of feed positions of the tool, comprising steps of:

prior to honing the bores of at least some of the workpieces, respectively, expanding the tool within the bore of the workpiece in a predetermined manner, under static conditions, until a predetermined feed force is reached, and measuring the feed system position;

between the honing of at least some of the bores, positioning the tool in a bore of known size and expanding the tool in the predetermined manner, under the static conditions, until the predetermined feed force is reached, and measuring the feed system position; and determining a target feed system position for honing each of the bores of the workpieces to the target size, respectively, as a function of the measured feed system positions and a predicted stone wear value.

18. A method as claimed in claim 17, wherein the predicted stone wear value is determined as a function of an amount of material to be removed from the bore by honing the bore.

* * * * *